US006925767B2

(12) United States Patent
Krochmal et al.

(10) Patent No.: US 6,925,767 B2
(45) Date of Patent: Aug. 9, 2005

(54) SCREWLESS WINDOW FRAME ASSEMBLY

(75) Inventors: Andrew R. Krochmal, Grand Haven, MI (US); Benjamin P. Hummel, Fennville, MI (US)

(73) Assignee: ODL, Incorporated, Zeeland, MI (US)

( * ) Notice: Subject to any disclaimer, the term of this patent is extended or adjusted under 35 U.S.C. 154(b) by 275 days.

(21) Appl. No.: 10/267,167

(22) Filed: Oct. 9, 2002

(65) Prior Publication Data

US 2004/0068942 A1 Apr. 15, 2004

(51) Int. Cl.[7] ..... E06B 1/04; E06B 3/58

(52) U.S. Cl. ..... 52/455; 52/212; 52/204.62; 49/504

(58) Field of Search ..... 52/204.53, 204.62, 52/204.67, 204.71, 212–213, 455–457, 464, 656.5, 784.1; 49/504–505, 322

(56) References Cited

U.S. PATENT DOCUMENTS 3,750,358 A * 8/1973 Lewkowitz ..... 52/204.597
3,903,669 A * 9/1975 Pease et al. ..... 52/455
4,735,025 A * 4/1988 Day ..... 52/217
5,570,548 A * 11/1996 Hopper ..... 52/204.5
5,634,508 A * 6/1997 Herbst ..... 49/503
5,894,706 A * 4/1999 Herbst ..... 52/782.1
6,272,801 B1 * 8/2001 Suh ..... 52/211
6,574,935 B2 * 6/2003 Wang Chen ..... 52/455
6,694,701 B2 * 2/2004 Wang et al. ..... 52/783.1
2003/0056442 A1 * 3/2003 Gerard ..... 49/504

FOREIGN PATENT DOCUMENTS

GB 2012848 * 8/1979

* cited by examiner

*Primary Examiner*—Winnie Yip
(74) *Attorney, Agent, or Firm*—Warner Norcross & Judd LLP

(57) ABSTRACT

A window frame including a pair of frame halves having integral fasteners for interconnecting the frame halves. The fasteners include mating barbed connectors that interfit with one another to permanently intersecure the frame halves. The fasteners further include integral cooperating alignment pins and receivers for aligning the fasteners and hence the frame halves. The alignment pins and receivers are laterally offset from the fasteners.

11 Claims, 5 Drawing Sheets

SCREWLESS WINDOW FRAME ASSEMBLY

BACKGROUND OF THE INVENTION

The present invention relates to window frames and more particularly to window frames that can be installed without screws or fasteners.

Window frames, such as those used in doorlights, are well known. Doorlight frames in particular, usually include two frame halves—one interior and one exterior—that are screwed together or otherwise interconnected. The frame halves are positioned on opposite sides of an object, such as a door, to support a glazing panel, such as insulated glass. Illustrative doorlight frames are illustrated in U.S. Pat. No. 5,644,881 issued Jul. 8, 1997 to Neilly; U.S. Pat. No. 5,133,168 issued Jul. 28, 1992 to Neilly et al; U.S. Pat. No. 4,920,718 issued May 1, 1990 to Artwick et al; and U.S. Pat. No. 4,021,967 issued May 10, 1977 to Mulder et al. Although these frames enjoy widespread popularity, they can be relatively time consuming to install. Additionally, the screws used to install the frames, as well as the accompanying screw holes, are unsightly after installation of the frame.

Some "screwless" doorlight frames have been developed in an attempt to solve these problems. An example is illustrated in U.S. patent application Ser. No. 09/412,763 filed Oct. 1, 1999 by Gerard. The Gerard construction includes two interconnecting systems—one for temporarily connecting the two halves and one for permanently connecting the two halves. Neither interconnecting system is visible from the exterior side of the frame.

Unfortunately, this Gerard frame, as well as similar screwless window frames, is not without its problems. One significant problem with the Gerard construction is that it can be difficult to properly align the two frame halves when attempting to permanently secure them. This increases the time necessary to install the frames. Additionally, with this construction it is possible to intersecure the frames out of alignment. Once the frame halves are interlocked it is extremely difficult to separate and reposition the frame halves, thus the consumer generally has the options of using the misaligned frame or installing a new system. The first option is aesthetically unpleasing and can reduce the life of the doorlight by allowing dust and debris into the frame from the misaligned portions. The latter option is both costly and time consuming.

SUMMARY OF THE INVENTION

The aforementioned problems are overcome by the present invention wherein a window frame includes an integral fastening system and an integral alignment system. The frame halves can easily be properly aligned and intersecured during the installation of a doorlight in a door. Preferably, the interconnecting system includes the alignment system.

As disclosed, the frame halves include mating barbed connectors that interfit with one another to permanently intersecure the frame halves. As further disclosed, each pair of connectors includes a male connector half and a female connector half.

In a further preferred embodiment, each pair of interlocking connectors includes a positioner and a positioner guide. The positioner rides along the positioner guide during installation to ensure proper alignment of the female connector half and male connector half.

The present invention provides a simple and effective window frame that is easily and securely aligned and interconnected. The connectors include positioning structures to ensure proper alignment of the frame halves.

These and other objects, advantages, and features of the invention will be more fully understood and appreciated by reference to the Detailed Description of the Preferred Embodiment and the drawings.

DETAILED DESCRIPTION OF THE PREFERRED EMBODIMENT

Figure 1:
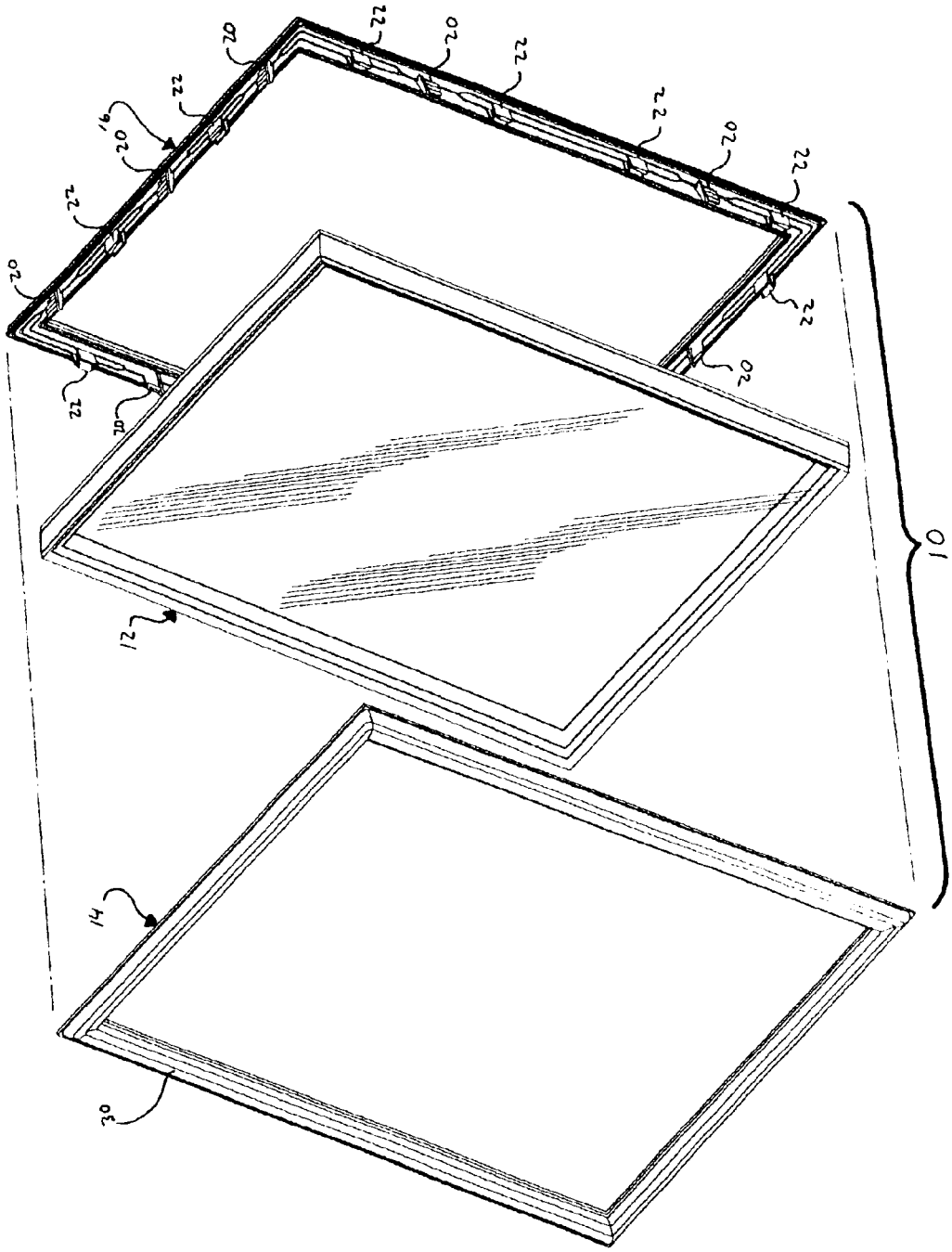
FIG. 1 is a perspective exploded view of a doorlight incorporating the window frame of the present invention.

A doorlight constructed in accordance with a preferred embodiment of the invention is illustrated in the drawings and generally designated 10. With reference to FIG. 1, the doorlight includes an insulated glass assembly 12, a first frame half 14 and a second frame half 16. The first and second frame halves 14, 16 have an interconnecting system including male pieces 20 and female pieces 22 (see FIGS. 4 and 5). These components securely connect the first and second frame halves 14, 16 when the first and second frame halves 14, 16 are pushed together to install them in a door. Each frame half includes gaskets 24 installed along gasket tracks 26. The gaskets 24 seal the glass assembly 12 between the first and second frame halves 14, 16 and seal the first and second frame halves 14, 16 to the door. Though the window frame assembly will be described with reference to a door and doorlight, it is to be understood that the present invention is suitable for use in a variety of settings, such as installation of windows in walls.

The present invention will now be described in greater detail with reference to FIGS. 2–7. The first frame half 14 and second frame half 16 are generally identical to one another and together comprise a single window frame. Because the two frame halves are identical, only the first frame half 14 will be described in detail.

The first frame half 14 is generally a single integral piece injection molded of high strength plastic. Preferably, the plastic is stainable and/or paintable such as the frames sold by ODL, Incorporated of Zeeland, Michigan under the trademark HP PRO™. Other materials suitable for construction of the frame halves are well known to those skilled in the art.

The first frame half 14 includes an external surface 30 which provides a molding appearance. Appropriate shapes for the external surface 30 are known to those skilled in the art Often, the surface is configured and/or textured to simulate the appearance of wood molding.

The first frame half 14 includes a door engagement portion 32 and a glass engagement portion 34. Each door engagement portion 32 and glass engagement portion 34 defines a gasket track 26 facing the door D or glass 12, respectively. The gasket track 26 is a substantially U-shaped channel running the length of each side of the first frame half 14. Though the invention will be described in relation to a U-shaped gasket track, the gasket track 26 may be any other shape, such as semicircular, as desired.

A gasket 24 is attached along the length of the gasket track 26. If the novel gasket track and gasket are not used, a caulk or other sealant may be applied along the door engagement portion 32 and glass engagement portion 34 to enhance sealing against the respective components.

Figure 2:
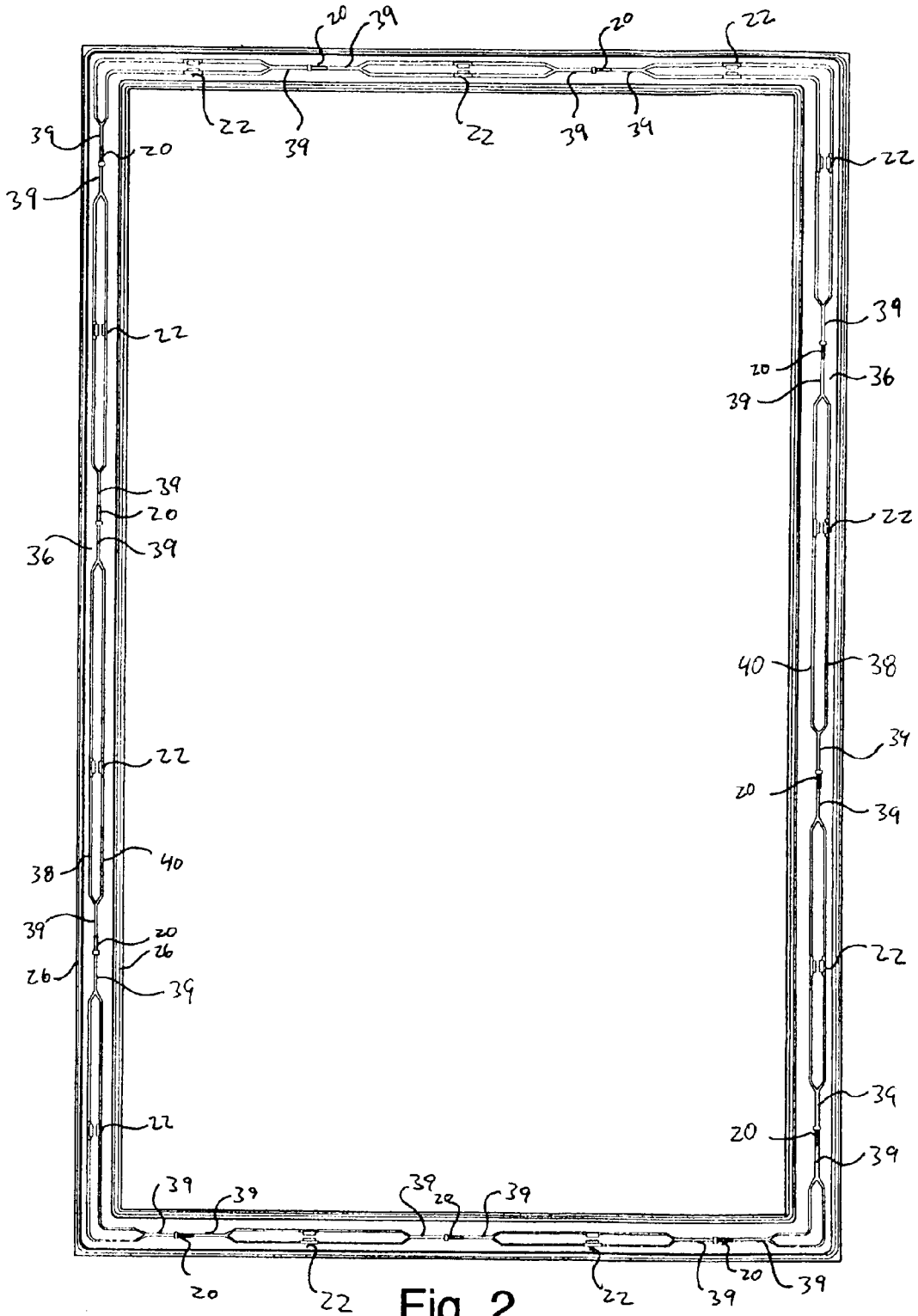
FIG. 2 is an interior plan view of the first frame half.
Figure 3:
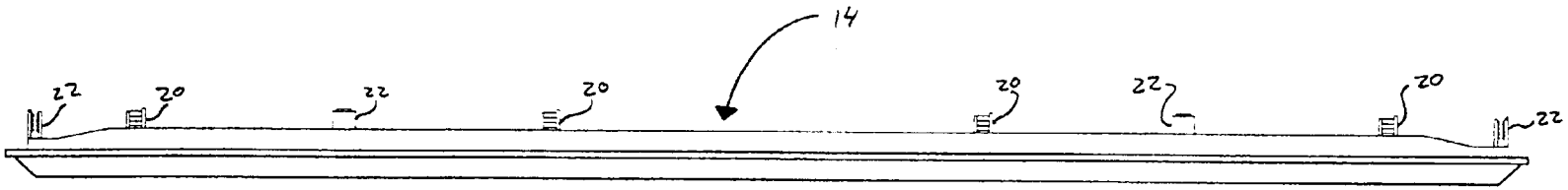
FIG. 3 is a side elevational view of the first frame half.

The underside 36 of the first frame half 14 is perhaps best illustrated in FIG. 2. This side of the frame includes a pair of integrally molded reinforcing longitudinal ribs 38 and 40, which extend around the entire perimeter of the first frame half 14. Lateral or transverse ribs 42 are optionally spaced around the perimeter of the first frame half 14 and are perpendicular to the longitudinal ribs 38 and 40. All of the ribs provide enhanced structural integrity for the first frame half 14, and they also support the other frame components discussed below. Because the first frame half 14 is a single injection molded component, the ribs 38, 40, 42 are integral with the frame and with one another.

The interconnecting system consists of male pieces 20 and female pieces 22. As can be seen in FIG. 2, a small distance from either side of each male piece the longitudinal ribs 38, 40 join so that a single rib 39 projects from both sides of each male piece 20. Each male piece 20 projects upwardly from a single rib 39.

Figure 4:
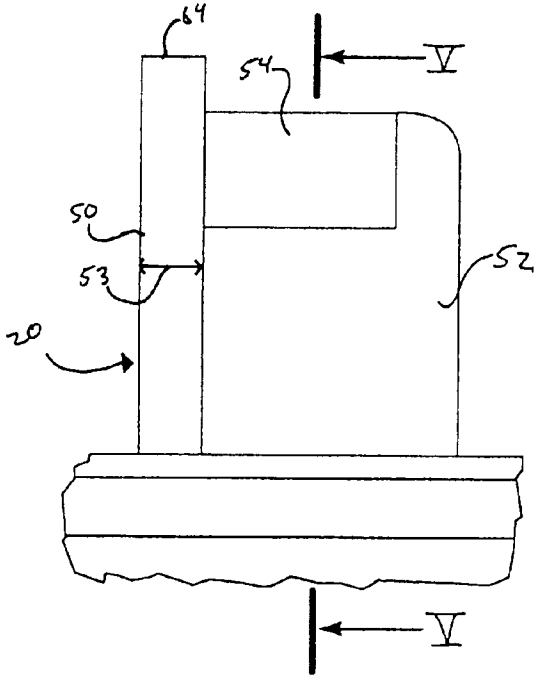
FIG. 4 is a side elevational view of a male piece of the first frame half.
Figure 5:
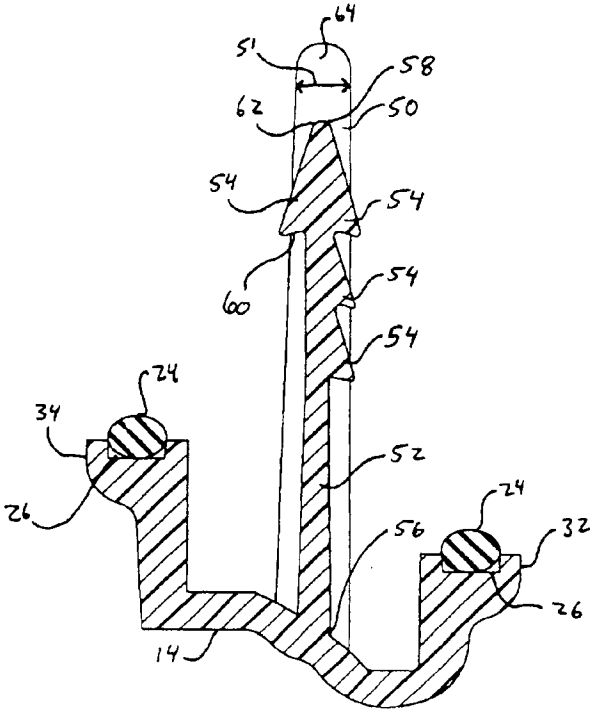
FIG. 5 is a cross-sectional view of the male piece taken along line V—V.

The male pieces 20, which can perhaps be best understood with reference to FIGS. 4 and 5, consist of a positioner 50, a stem 52 and a number of barbs 54. Each male piece 20 is preferably molded as an integral piece, and is more preferably integrally molded with the frame half to which it is attached. The stem 52 is a rectangular tab having a first end 56 and a second end 58. The first end 56 is connected to the first frame half 14 so that the stem 52 projects outwardly from the first frame half 14. The stem 52 is preferably connected to the first frame half 14 so that the stem 52 is centered between the door engagement portion 32 and the glass engagement portion 34. The second end 58 of the stem 52 is rounded to facilitate insertion of the male piece 20 into the female piece 22, as will be discussed in further detail below.

The barbs 54 are substantially triangular, each barb having a base 60 and a tip 62. The barbs 54 protrude from the sides of the stem 52 so that the base 60 slopes slightly downward from the stem 52, the base 60 of each barb 54 forming an acute angle with the stem 52. The barbs 54 are stacked on both sides of the stem 52 so that the tip 62 of each barb 54 contacts the base 60 of the next higher barb 54 in the stack. There are preferably three barbs 54 stacked on the door engagement side of the stem 52 and one barb 54 on the glass engagement side of the stem 52.

The positioner 50 is a substantially rectangular tab having a width 51 and a depth 53. The positioner 50 is attached to one end of the stem 52. In a preferred embodiment, the positioner 50 is slightly taller than the stem 52 so that an end 64 of the positioner 50 extends beyond the height of the stem 52. The end 64 of the positioner 50 is rounded to facilitate insertion of the male piece 20 into the female piece 22. The width 51 of the positioner 50 preferably is such that the edges of the positioner 50 extend beyond the sides of the stem 52 but do not extend beyond the bases 60 of the barbs 54, as can be seen in FIG. 5.

Figure 6:
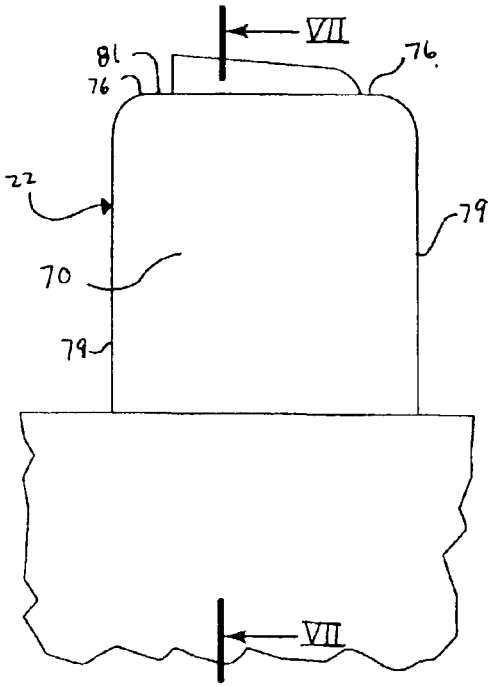
FIG. 6 is a side elevational view of a female piece of the first frame half.
Figure 7:
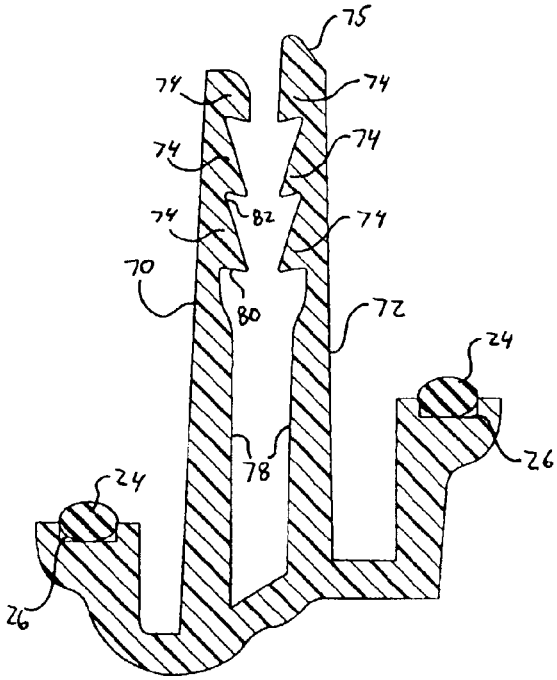
FIG. 7 is a cross-sectional view of the female piece taken along line VII—VII.

As can perhaps be best seen in FIGS. 6 and 7, each female piece 22 consists of a first wall 70, a second wall 72, a number of teeth 74 and two positioner guides 76. Each female piece 22 is preferably molded as an integral piece, and is more preferably integrally molded with the frame half to which it is attached. Each of the first wall 70 and second wall 72 has an inner surface 78 and two side edges 79 and a top edge 81. Each wall is attached to a longitudinal rib 38, 40 so that the inner surface 78 of the first wall 70 faces the inner surface of the second wall 72. The height of the first wall 70 and second wall 72 is at least the height of the positioner 50.

A number of triangular teeth 74 project inwardly from the inner surface 78 of each wall. Each tooth 74 has a base 80 and a tip 82. The teeth 74 protrude from the inner surface 78 of each wall so that the base 80 slopes slightly downward respective to the wall from which it protrudes, the base 80 of each tooth 74 forming an acute angle with the wall. The teeth 74 are stacked on the inner surface 78 of both the first wall 70 and the second wall 72 so that the tip 82 of each tooth 74 contacts the base 80 of the next higher tooth 74 in the stack. In a preferred embodiment, three teeth 74 are stacked on each of the first wall 70 and the second wall 72. The tip 82 of the top tooth 74 in each stack preferably contacts the top edge 81 of the respective wall. In an alternative embodiment, the top tooth 74 in the stack on one of the first wall 70 or second wall 72 extends slightly beyond the top of the respective wall. In this embodiment, a ramp 75 exists on the portion of the tooth 74 that extends beyond the wall. The ramp 75 is a section of the outer surface of the tooth 74 that is inclined toward the section of the tooth 74 that projects beyond the top of the wall. The ramp 75 is located on the top tooth 74 such that when the frames are installed, the ramp 75 contacts the insulated glass assembly 12. Optionally, the upper portion of each wall (the portion including teeth 74) is thinner than the lower portion of each wall (the portion without teeth 74.)

The teeth 74 preferably are centered on each wall 70, 72. The distance between the edge of each tooth 74 and the respective side edge 79 is at least equal to the depth 53 of the positioner 50 so that a positioner guide 76 is defined along each edge of the female piece 22. The positioner guide 76 is a channel that runs the height of the female piece 22 the depth of which is at least the depth 53 of the positioner 50.

The male pieces 20 and female pieces 22 are spaced about each of the first frame half 14 and second frame half 16 so that, when the first frame half 14 and second frame half 16 are positioned opposite each other during installation, every male piece 20 is aligned with a female piece 22.

Assembly and Use

The first frame half 14 and second frame half 16 are injection molded using known techniques. The insulated glass 12 also is fabricated using known techniques and, as is obvious to those skilled in the art, includes two panes and a spacer. The first frame half 14 is positioned over a support surface. If used, the gasket 24 is applied along all gasket tracks 26 of the first frame half 14. The insulated glass assembly 12 and door D are laid over the first frame half 14 so as to engage the glass engagement portion 34 and door engagement portion 32, respectively. The gaskets 24 are compressed somewhat at this point due to the pressure placed on the gaskets 24 by the door D and insulated glass assembly 12.

The second frame half 16 is then laid flat and, if used, the gasket 24 is applied along all gasket tracks 26 of the second frame half 16. The second frame half 16 is laid over the door D and insulated glass assembly 12 so that the door engagement portion 32 and glass engagement portion 34 of the second frame half contact the door D and insulated glass assembly 12, respectively.

The second frame half 16 is forced down onto the first frame half 14. This can be done by any conventional method, such as by hand or using a rubber mallet. The gaskets 24 on the first frame half 14 and second frame half 16 are compressed where necessary when pressure is applied to the second frame half 16. The degree to which the gaskets 24 are compressed will vary depending on the dimensions of the door D and insulated glass assembly 12. Because the gaskets 24 will compress to accommodate the door D and insulated glass assembly 12 and will seal any gap that exists between the first and second frame halves 14, 16 and those components, the gaskets allow the window frame 10 to be used with doors and windows of various dimensions.

Figure 8:
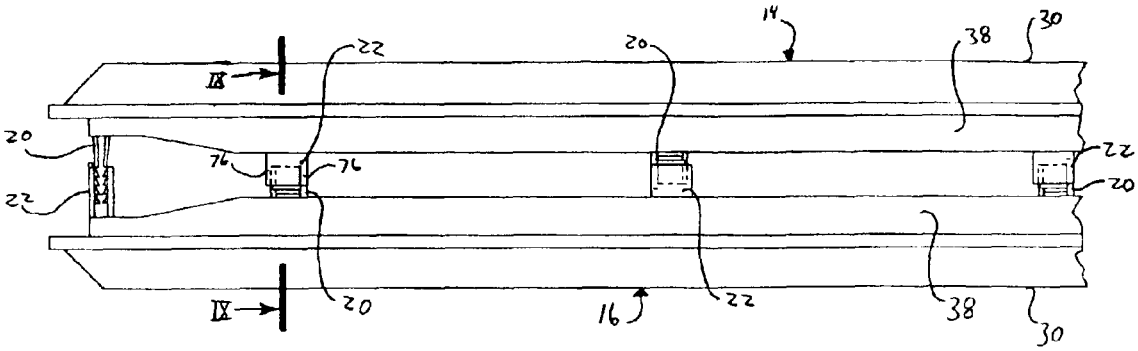
FIG. 8 is an end elevational view of the assembled frame.
Figure 9:
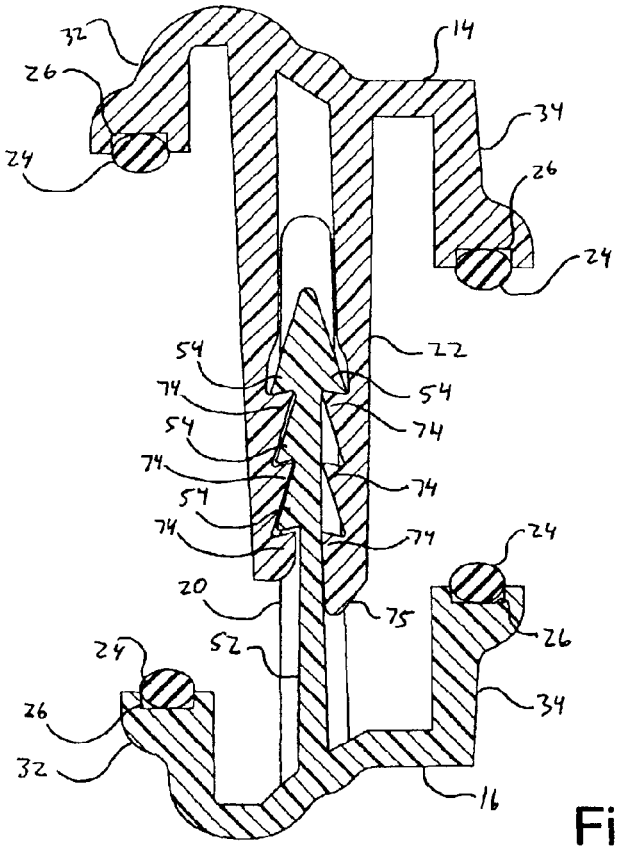
FIG. 9 is a cross-sectional view taken along line IX—IX of FIG. 8.

As the frame halves 14, 16 move together, each positioner 50 aligns with and is accepted by a positioner guide 76. The interaction of the positioner 50 and positioner guide 76 appropriately aligns the male pieces 20 and the female pieces 22 so that the stem 52 and barbs 54 of the male pieces will enter the walls 70, 72 of the female pieces 22 at the section of the walls 70, 72 having teeth 74. As the second frame half 16 is pressed onto the first frame half 14, the barbs 54 interlock with the teeth 74 as shown in FIGS. 8 and 9 to essentially permanently secure the first frame half 14 to the second frame half 16. The ramp 75 rides along the pane furthest from the ribs 38, 40 to which the female piece 22 is attached. This guides the female piece 22 past the pane of the insulated glass assembly 12. The intersecurement of the first frame half 14 and second frame half 16 maintains the insulated glass assembly 12 in position with respect to the door D.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

What is claimed is:

1. A window frame comprising:

a first frame half including integral barbed projections;

a second frame half including integral barbed receivers positioned to receive said barbed projections when said frames are aligned; and alignment means for aligning pairs of said barbed projections and said barbed receivers to facilitate interconnection of said first frame half and said second frame half, said alignment means including an alignment pin integral with and laterally offset from each of said barbed projections, and an alignment guide interal with and laterally offset from each of said barbed receivers, each said alignment pin being taller than the associated barbed projection to enter the associated alignment guide before the associated projections enters the associated receivers as said frame halves are brought together, said alignment pins capable of entering said alignment guides but not said barbed receivers.

2. A window frame as defined in claim 1 wherein each of said projections includes a stem and at least one barb and each of said receivers includes at least one barb, said alignment pin integral with said stem and laterally spaced from said at least one barb.

3. A window frame as defined in claim 1 further including a gasket extending around the entire perimeter of each of said first frame half and said second frame half.

4. A window frame as defined in claim 3 wherein the first frame half and second frame half are identical.

5. A window frame as defined in claim 1 further including at least one gasket track on each of said first and second frame halves.

6. A window frame comprising:

a first frame half;

a second frame half;

interconnecting means integral with said first frame half and said second frame half for permanently intersecuring said frame halves, said interconnecting means including a plurality of interconnecting pairs of first and second connector pieces on said first and second frame halves respectively; and alignment means integral with said interconnecting means, said alignment means including alignment pairs of first and second alignment pieces associated with selected ones of said interconnecting pairs, said alignment pairs positioned and configured to interfit before said interconnecting pairs interfit as said frame halves are brought together, each pair of alignment pieces being laterally spaced from the associated pair of interconnecting pieces, whereby said alignment means aligns said interconnecting means as the frame halves are brought together.

7. A window frame as defined in claim 6 wherein said interconnecting pieces includes male pieces and female pieces.

8. A window frame as defined in claim 7 wherein said alignment pieces includes at least one positioner and at least one positioner guide.

9. A window frame as defined in claim 8 wherein each of said male pieces includes a stem and at least one barb and each of said female pieces includes a plurality of walls and at least one tooth.

10. A window frame as defined in claim 9 further including a gasket on each of said first frame half and said second frame half.

11. A window frame as defined in claim 10 wherein said first frame half and said second frame half are identical.

* * * * *

UNITED STATES PATENT AND TRADEMARK OFFICE

CERTIFICATE OF CORRECTION

PATENT NO. : 6,925,767 B2
DATED : August 9, 2005
INVENTOR(S) : Andrew R. Krochmal et al.

It is certified that error appears in the above-identified patent and that said Letters Patent is hereby corrected as shown below:

Column 6,
Line 1, “interal” should be -- integral --.
Line 6, “receivers” should be -- receiver --.
Line 46, “includes” should be -- include --.

Signed and Sealed this

Twenty-second Day of November, 2005

JON W. DUDAS
*Director of the United States Patent and Trademark Office*